US012050075B1

(12) United States Patent
Horn

(10) Patent No.: US 12,050,075 B1
(45) Date of Patent: Jul. 30, 2024

(54) EXTENDIBLE FIREARM STAND

(71) Applicant: Aaron Lynn Horn, Sonora, CA (US)

(72) Inventor: Aaron Lynn Horn, Sonora, CA (US)

( * ) Notice: Subject to any disclaimer, the term of this patent is extended or adjusted under 35 U.S.C. 154(b) by 0 days.

(21) Appl. No.: 18/634,770

(22) Filed: Apr. 12, 2024

Related U.S. Application Data

(63) Continuation-in-part of application No. 29/933,053, filed on Mar. 18, 2024.

(60) Provisional application No. 63/489,610, filed on Mar. 10, 2023.

(51) Int. Cl.
*F41A 23/16* (2006.01)

(52) U.S. Cl.
CPC ..... *F41A 23/16* (2013.01)

(58) Field of Classification Search
CPC ..... F41A 23/16; F41A 23/18
See application file for complete search history.

(56) References Cited

U.S. PATENT DOCUMENTS 3,952,878 A * 4/1976 Gorham ..... F41A 23/18 248/161
4,089,423 A * 5/1978 Gorham ..... F41A 23/18 248/156
4,144,971 A * 3/1979 Balibrea ..... F41A 23/18 248/156
4,271,969 A * 6/1981 Gnesa ..... F41A 23/18 248/156
4,319,726 A * 3/1982 Andersson ..... B65B 67/12 248/156
D314,287 S * 2/1991 Albright, Sr. ..... D6/552
5,012,606 A * 5/1991 McNulty, Jr. ..... A47B 81/005 361/194
5,183,231 A * 2/1993 Pellerin ..... F41B 5/14 248/156
D398,949 S * 9/1998 Franks ..... D22/100
D476,168 S * 6/2003 Forrest ..... D6/681.2
6,935,065 B1 * 8/2005 Oliver ..... F41A 23/04 248/161
D517,343 S * 3/2006 Hayes ..... D6/403
7,124,530 B1 * 10/2006 Clark ..... F41A 23/18 42/90
D600,302 S * 9/2009 Kelly ..... D22/108
D604,077 S * 11/2009 Cardenas ..... D6/552
D629,064 S * 12/2010 Riley ..... D22/107
2006/0213109 A1 * 9/2006 Zunker ..... A45B 3/00 43/21.2

(Continued)

*Primary Examiner* — Joshua E Freeman
(74) *Attorney, Agent, or Firm* — QuickPatents; Kevin Prince

(57) ABSTRACT

An extendible firearm stand is designed to provide adjustable and stable support for a firearm. The stand features a telescopic structure with an inner tube for ground insertion and an outer tube equipped with a ringed ledge to hold the firearm. A locking mechanism allows for swift and secure height adjustments, accommodating different user heights and shooting positions. The inclusion of a carrying handle enhances the stand's portability, facilitating easy transport and deployment in the field. This stand supports the firearm in a vertical orientation, offering a stable base for hunters and shooters without the need for manual holding. The invention addresses the drawbacks of prior designs by combining stability, adjustability, and convenience, making it a valuable tool for outdoor shooting activities.

9 Claims, 6 Drawing Sheets

(56) References Cited

U.S. PATENT DOCUMENTS

| | | | | |
|---|---|---|---|---|
| 2010/0123056 | A1* | 5/2010 | Cardenas | A01K 97/10<br>248/150 |
| 2018/0289153 | A1* | 10/2018 | Sanchez | A47B 81/005 |
| 2021/0107410 | A1* | 4/2021 | Franklin | B60R 7/14 |

* cited by examiner

EXTENDIBLE FIREARM STAND

CROSS REFERENCE TO RELATED APPLICATIONS

This application claims the benefit of U.S. Provisional Patent Application 63/489,610, filed on Apr. 27, 2023, and is also a Continuation-in-Part of US Design Patent Application 29/933,053, filed on Mar. 18, 2024, both being incorporated herein by reference.

STATEMENT REGARDING FEDERALLY SPONSORED RESEARCH AND DEVELOPMENT

Not Applicable.

FIELD OF THE INVENTION

This invention relates to hunting, and more particularly to a firearm stand.

BACKGROUND

The field of firearm supports has seen various developments aimed at providing stability and convenience for users, particularly in outdoor and hunting environments. Prior art in this domain has introduced several solutions, each with its own set of features and limitations.

For example, U.S. Pat. No. 4,144,971 to Balibrea on Mar. 20, 1979, discloses an earth-engageable gun stand with a rigid support shaft and multiple stake members. While this patent presents a portable solution for supporting firearms, it lacks the adjustability and flexibility required for various terrains and user preferences. Moreover it is difficult to transport and store this device as it does not collapse down to a smaller, more manageable size.

U.S. Pat. No. 5,680,939 to Oliver on Oct. 28, 1997, describes a ground-engageable gun support apparatus featuring a pair of generally parallel tubes used as the support structure. This patent introduces an adjustable elongated tube with a butt support tray and a "Y" shaped barrel support bracket. Despite these advancements, the apparatus still requires a cumbersome manual adjustment and lacks an integrated locking mechanism to swiftly secure the firearm at the desired height, potentially affecting the user's speed and ease of use. It's relatively large size is a further hinderance while transporting or storing the device.

U.S. Pat. No. 9,107,498 to Wooten on Aug. 18, 2015, presents a weapon support assembly that provides support for both bows and firearms. While it does offer a solution for firearm users, the design is relatively large and bulky, which poses challenges for storage and transport. The lack of a compact, collapsible configuration can be cumbersome for users who need to move quickly and discreetly in various hunting environments.

The aforementioned patents represent steps in the evolution of firearm supports. However, they also highlight the need for an invention that addresses their drawbacks. A needed invention in this field would include an extendible and adjustable stand that offers quick and secure height adjustment, stability on various terrains, and the versatility to support different firearm types. It would also benefit from a compact and portable design that allows for easy transportation and rapid deployment in the field.

The present invention accomplishes these objectives.

SUMMARY OF THE INVENTION

The present invention pertains to an extendible firearm stand, meticulously designed to offer a stable and adjustable support system for firearms such as rifles and shotguns. The stand features a telescopic design comprising two main components: an inner tube with a pointed lower end and a footstep for secure ground insertion, and an outer tube with a ringed ledge to cradle the firearm. The inner tube slides within the outer tube, allowing for height adjustment to accommodate various shooting positions and user preferences, such as holding the firearm up out of a wet marsh, for example.

A key innovation of the extendible stand is its locking mechanism, which enables the user to quickly and securely fix the height of the stand. This mechanism is intuitive and user-friendly, ensuring that the firearm can be positioned at the desired elevation with minimal effort. Additionally, the stand may include a carrying handle, enhancing its portability and making it convenient to transport when collapsed.

The design of the stand allows for the firearm to be supported in a substantially vertical orientation, which is particularly beneficial in field or target shooting environments. The stand's ability to be quickly adjusted and securely positioned makes it an invaluable tool for hunters and shooters who require a stable base for their firearms without the need for constant manual support.

Overall, the extendible firearm stand represents a significant advancement in firearm support technology. Its combination of stability, adjustability, and ease of transport addresses the limitations of previous designs and provides users with a practical solution that enhances their shooting experience. The stand's robust construction ensures durability, while its thoughtful design guarantees functionality and user satisfaction in various outdoor settings. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
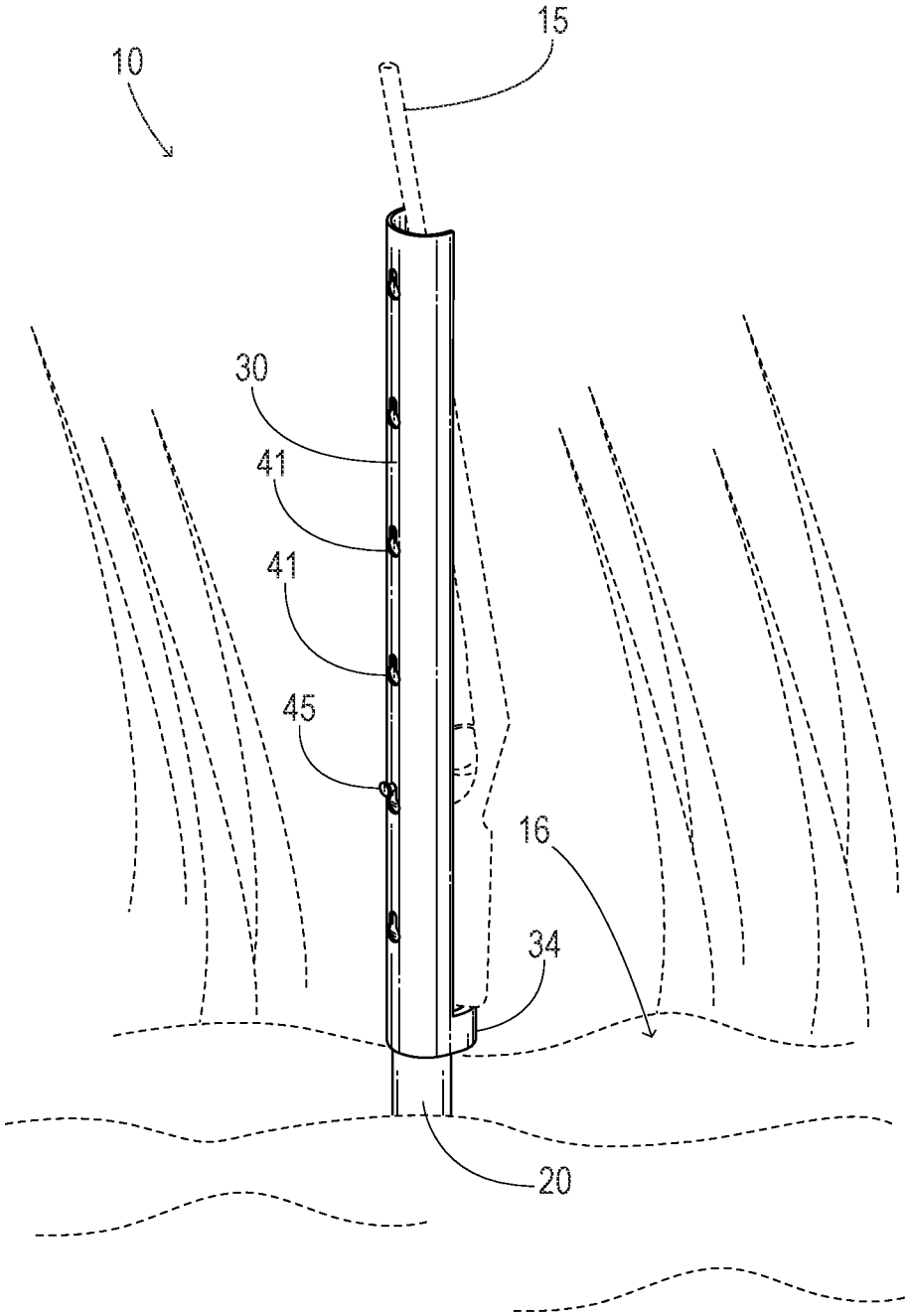
FIG. 1 is a front perspective view of the invention, illustrated in an extended configuration.
Figure 2:
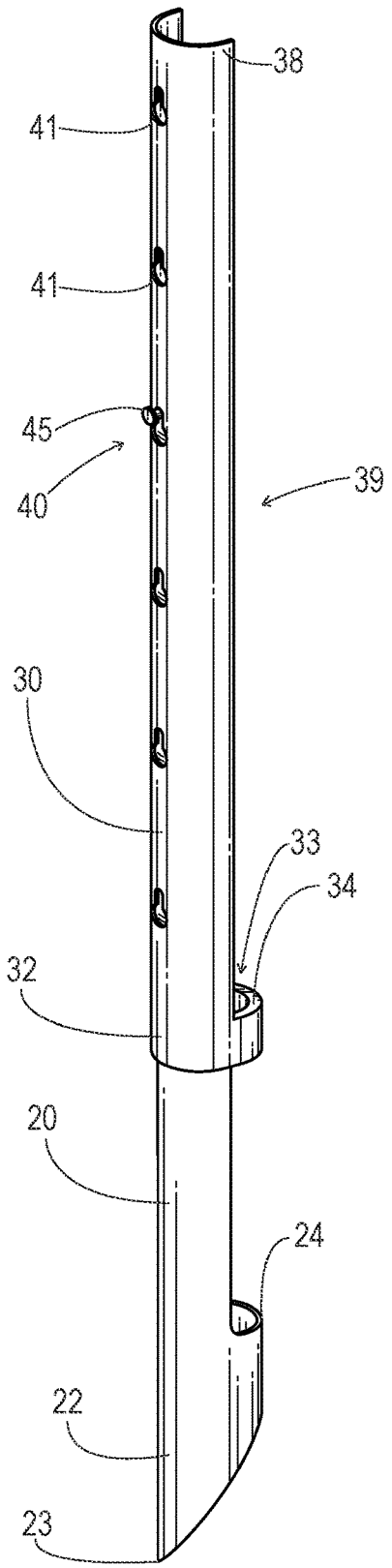
FIG. 2 is an enlarged front perspective view thereof.
Figure 3:
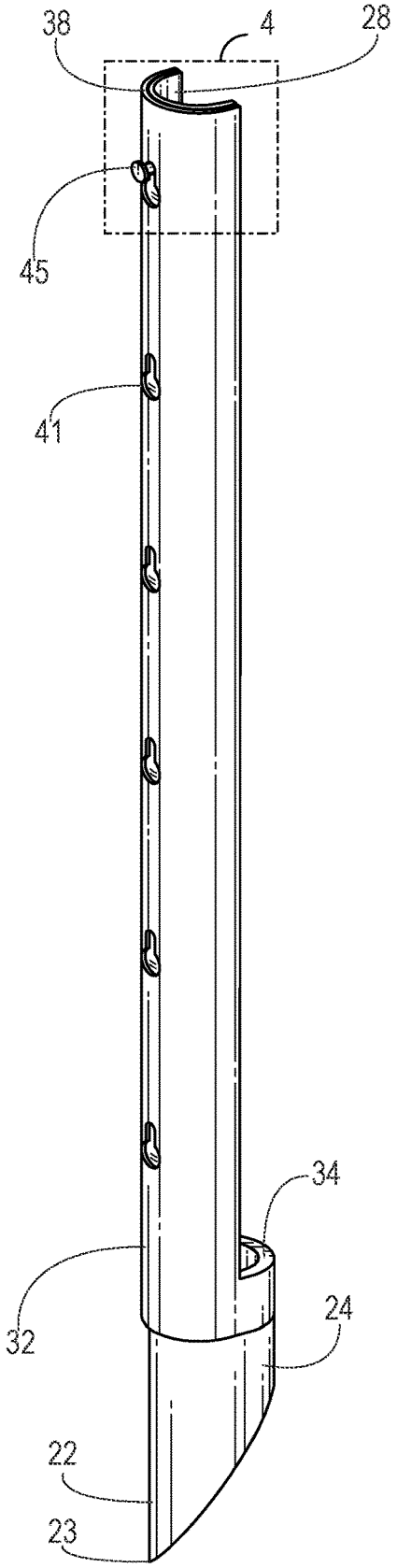
FIG. 3 is a front perspective view of the invention, illustrated in a collapsed configuration.

FIGS. 1-3 illustrate an extendible stand 10 for holding a firearm 15 above a soft ground surface 16, such as a marsh or other hunting grounds. The stand 10 is designed to provide stability and accessibility for the firearm 15 during use in various environments, particularly in outdoor settings, and is designed to be easily set-up and removed.

A first inner tube 20 includes an upper end 28 and a lower end 22 terminating at a point 23 and having a foot step 24. The point 23 at the lower end 22 of the first inner tube 20 is configured for easily piercing the soft ground surface 16. The first tube 20 is open on a rearward side 21 between the step 24 and the upper end 28 and is configured for receiving the firearm 15 therein. The first inner tube 20 can be constructed from materials such as aluminum, steel, or durable plastic composites, which offer the necessary strength and rigidity while also being lightweight for ease of transportation.

A second outer tube 30 comprises an upper end 38 and a lower end 32 terminating in a ringed firearm ledge 34 open in a center portion 33 thereof. The second outer tube 30 has an open area 39 between the firearm ledge 34 and the upper end 38 thereof and is configured for slidably receiving the first inner tube 20 therein. This second outer tube 30 may be made from similar materials as the first inner tube 20, ensuring that it provides a secure and stable structure when extended. The first inner tube 20 and the second outer tube 30 are optionally made from materials that are buoyant in water. Suitable materials for this feature can include certain plastics or composite materials that provide buoyancy, ensuring that the stand 10 can be retrieved easily if dropped in water. Both the first inner tube 20 and the second outer tube 30 preferably have cooperative oval cross-sections, but may have other cross-sectional shapes such as square or circular (not shown).

Figure 4:
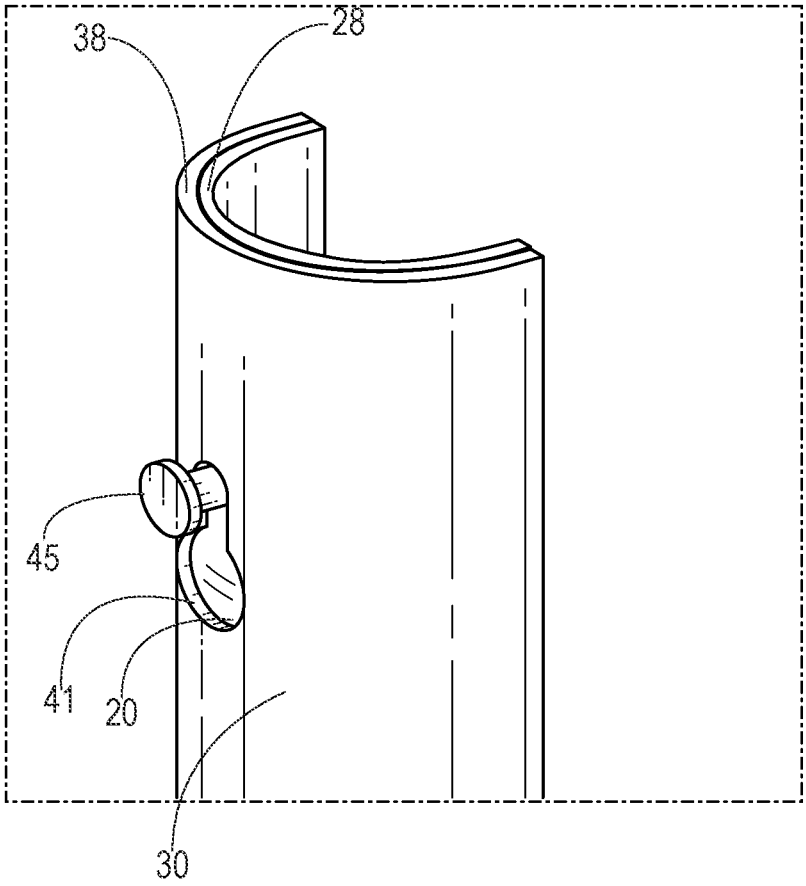
FIG. 4 is an enlarged partial front perspective view thereof, taken along line 4-4 of FIG. 3.
Figure 5:
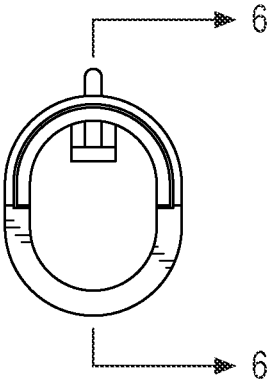
FIG. 5 is a top plan view thereof, illustrating one embodiment of a locking mechanism as shown in FIG. 6A.
Figure 6B:
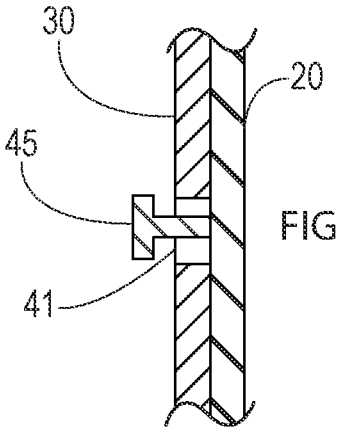
FIG. 6B is a cross-sectional view similar to FIG. 6A, but showing a different and preferred locking mechanism embodiment.
Figure 6A:
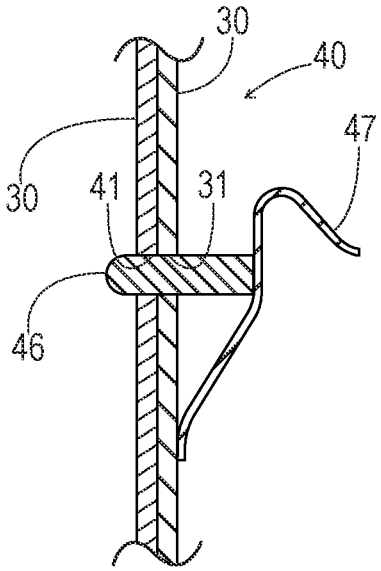
FIG. 6A is a cross-sectional view thereof, taken along line 6-6 of FIG. 5, illustrating one embodiment of a locking mechanism.
Figure 6C:
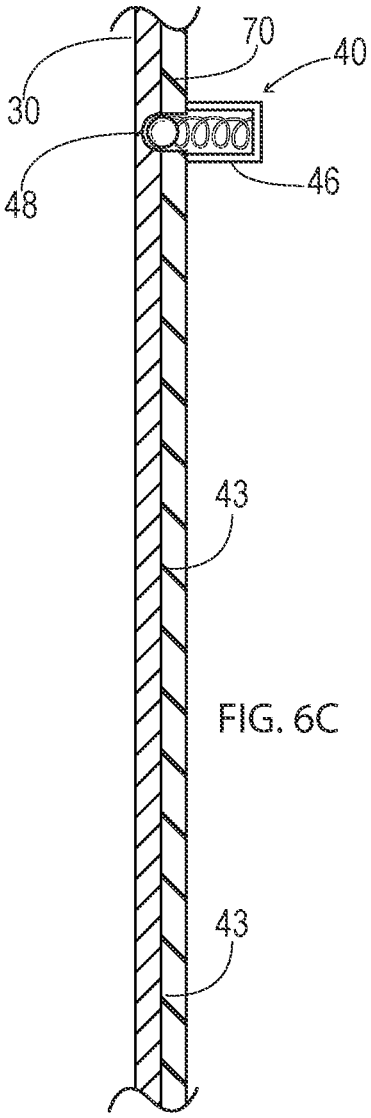
FIG. 6C is a cross-sectional view similar to FIG. 6B, but showing another different locking mechanism embodiment.

A locking mechanism 40 (FIGS. 4-6D) is configured for fixing the first inner tube 20 within the second outer tube 30 at a desired relative position to prevent relative sliding thereof. The locking mechanism 40 can be a simple pin and hole arrangement (FIGS. 4 and 6A), a clamping mechanism, or the like. The locking mechanism 40 preferably includes a plurality of keyhole apertures 41 in the second outer tube 30, and a pin 45 projecting away from an outer surface of the first inner tube 20 proximate the upper end thereof. The pin 45 may be selectively pushed manually out of one of the keyhole apertures 41 to allow relative sliding between the first inner tube 20 to the second outer tube 30, and then re-inserted into a selected one of the keyhole apertures 41 to secure the inner tube 20 and the outer tube 30 mutually together.

In an optional embodiment, the locking mechanism 40 includes a plurality of apertures 42 in the first inner tube 20, and a spring-biased pin 46 (FIGS. 5 and 6A) projecting through a pin aperture 31 of the second outer tube 30 and through one of the apertures 42 of the second outer tube 30. As such, the spring-biased pin 46 may be selectively pushed manually out of one of the apertures 42 to allow the relative sliding between the first inner tube 20 and the second outer tube 30. Upon release of the spring-biased pin 46, the spring-biased pin 46 traverses one of the apertures 42 to lock the first inner tube 20 and the second outer tube 30 mutually together. The locking mechanism 40 is preferably designed to be operated with a single hand to allow for quick adjustment of the stand 10 height while holding the firearm 15 with the other hand. This can include an ergonomic thumb press 47 on the locking mechanism 40, for example.

In yet another optional embodiment, the locking mechanism 40 includes a spring-loaded detent ball 48 (FIG. 6C) that engages with multiple recesses 43 along a length of the first inner tube 20 to allow for adjustable height settings.

Figure 7:
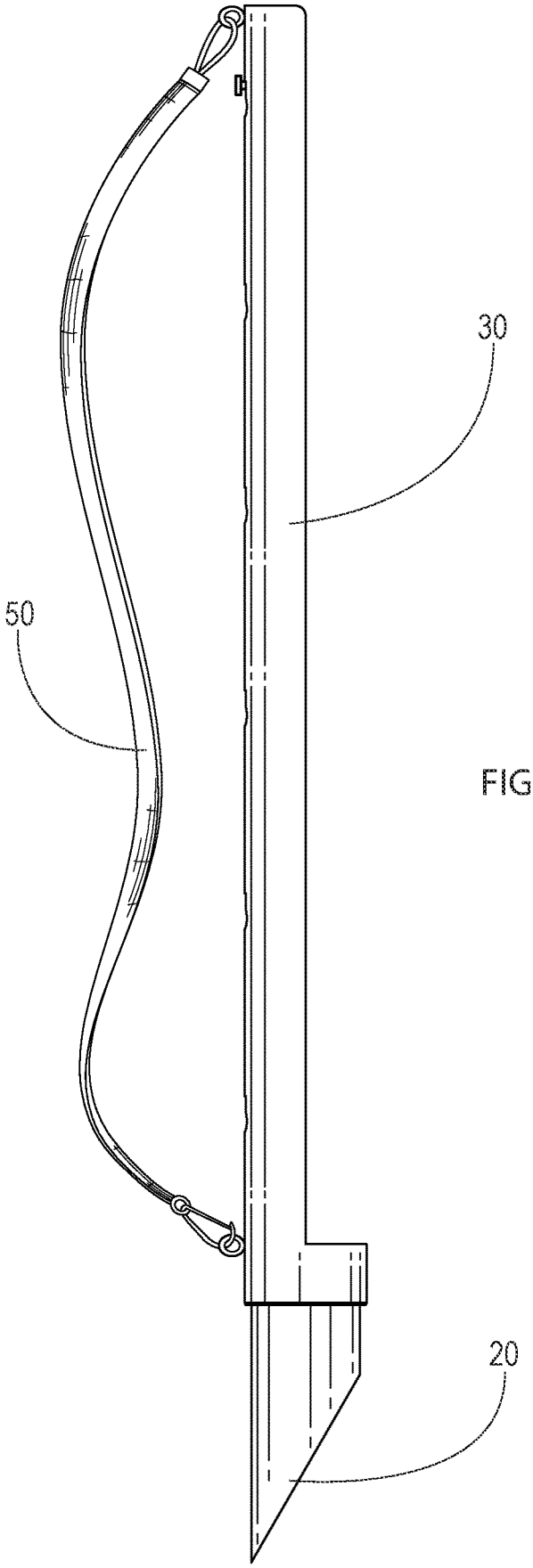
FIG. 7 is a side elevational view of the invention illustrated in the collapsed configuration and showing an optional carrying handle.
Figure 8:
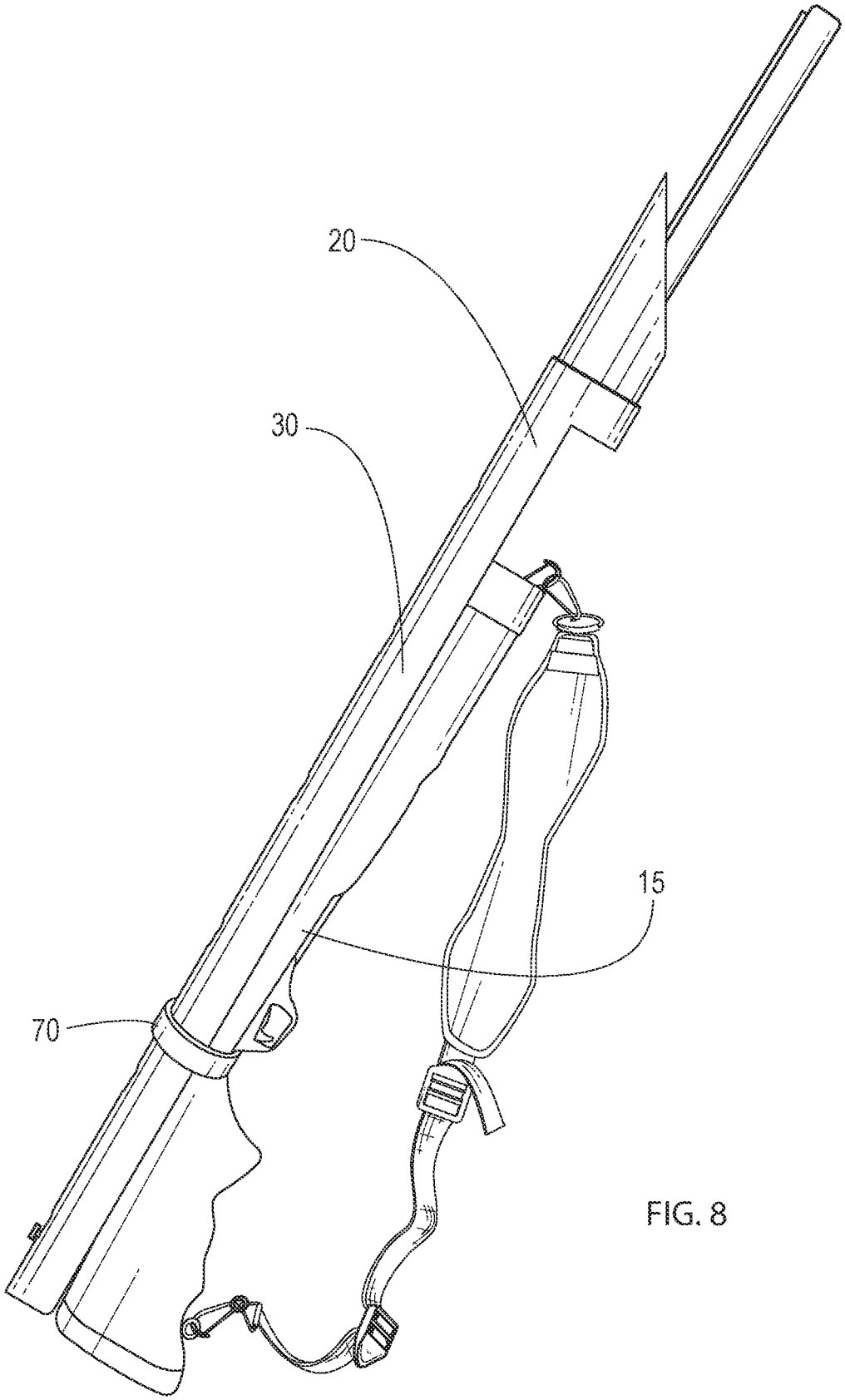
FIG. 8 is a side perspective illustration of an alternate configuration for compactly storing and transporting the invention while mounted to the firearm.

A carrying handle 50 (FIG. 7) may be attached to the second outer tube 30 for ease of transport when in a collapsed configuration 60. The handle 50 can be made from rubberized materials, nylon strap material, or padded fabrics for comfort during transportation. Such a carrying handle 50 may be printed with a camouflage pattern (not shown) or a dark color so as to be difficult to see from a distance. Alternately, as illustrated in FIG. 8, the firearm 15 may be mounted within the first inner tube 20 and strapped to the firearm 15 with a strap or tie 70.

Each of these optional features enhances the functionality and user experience of the extendible stand 10, providing additional convenience, adjustability, and portability to suit the needs of various users in different environments.

While a particular form of the invention has been illustrated and described, it will be apparent that various modifications can be made without departing from the spirit and scope of the invention. For example, the cross-sectional shape of the first inner tube and the second outer tube is square, circular, or some other suitable shape. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An extendible stand (10) for holding a firearm (15) above a soft ground surface (16), comprising:

a first inner tube (20) comprising a lower end (22) terminating at a point (23) and having a foot step (24), and an upper end (28), the first tube being open on a rearward side (21) between the step and the upper end and configured for receiving the firearm therein;

a second outer tube (30) comprising a lower end (32) terminating in a ringed firearm ledge (34) open in a center portion (33) thereof, and an upper end (38), the second outer tube having an open area (39) between the firearm ledge and the upper end thereof, the second outer tube configured for slidably receiving the first inner tube therein; and a locking mechanism (40) configured for fixing the first inner tube within the second outer tube at a desired relative position to prevent relative sliding thereof;

whereby the first inner tube can be slide downwardly from the second inner tube to expose the foot step, the point of the lower end being driven through the soft ground surface by stepping on the foot step to a sufficient depth to keep the extendible stand upright, the second outer tube is slid upwardly to a desired height in an extended configuration (50), and the locking mechanism is locked, the firearm thereafter being rested on the firearm ledge and within the open area of the first inner tube, thereafter the first inner tube being pulled out of the ground surface, the locking mechanism being unlocked, and the second outer tube being slid down the first inner tube until the foot step contacts the ringed firearm ledge, the extendible stand thereby being placed in a collapsed configuration (60) for storage and transport.

2. The extendible stand of claim 1 wherein a cross-section of the first inner tube is oval, and wherein a cross-section of the second outer tube is oval.

3. The extendible stand of claim 1 wherein the locking mechanism include a plurality of keyhole apertures (41) in the second outer tube, and a pin (45) projecting away from an outer surface of the first inner tube proximate the upper end thereof, such that the pin may be selectively inserted into a selected one of the keyhole apertures to lock the first inner tube to the second outer tube.

4. The extendible stand of claim 1 wherein the first inner tube and the second outer tube are made from materials that are buoyant in water.

5. The extendible stand of claim 1 wherein the locking mechanism include a plurality of apertures (42) in the second outer tube, and a spring-biased pin (46) projecting away from an outer surface of the first inner tube proximate the upper end thereof, such that the pin may be selectively pushed manually out of one of the apertures to allow relative sliding between the first inner tube to the second outer tube, whereupon upon release of the spring-biased pin the pin traverses on of the apertures to lock the first inner tube and the second outer tube mutually together.

6. The extendible stand of claim 1 wherein the first inner tube and the second outer tube are constructed from a lightweight composite material.

7. The extendible stand of claim 1 wherein the locking mechanism includes a spring-loaded detent ball (48) that engages with multiple recesses (43) along a length of the first inner tube to allow for adjustable height settings.

8. The extendible stand of claim 1, further comprising a carrying handle (50) attached to the second outer tube for ease of transport when in the collapsed configuration.

9. The extendible stand of claim 1, wherein the locking mechanism is operable with a single hand to allow for quick adjustment of the stand height.

* * * * *